US008893604B1

(12) United States Patent
Gray et al.

(10) Patent No.: US 8,893,604 B1
(45) Date of Patent: Nov. 25, 2014

(54) MODULAR MUNITIONS DEPLOYMENT PLATFORM

(71) Applicants: Jeremy P. Gray, Southfield, MI (US); James R. Mason, Livonia, MI (US); Charles E. Dean, Shrewsbury, MA (US); Jacob P. Warren, Milford, MA (US)

(72) Inventors: Jeremy P. Gray, Southfield, MI (US); James R. Mason, Livonia, MI (US); Charles E. Dean, Shrewsbury, MA (US); Jacob P. Warren, Milford, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/755,383

(22) Filed: Jan. 31, 2013

Related U.S. Application Data

(60) Provisional application No. 61/594,633, filed on Feb. 3, 2012.

(51) Int. Cl.

| | |
|---|---|
| ***F41F 3/042*** | (2006.01) |
| ***F41H 7/00*** | (2006.01) |
| ***F41H 11/14*** | (2006.01) |
| ***F41H 11/16*** | (2011.01) |

(52) U.S. Cl.
CPC ..... *F41H 11/14* (2013.01); *F41H 11/16* (2013.01)
USPC ..... 89/1.13; 89/1.11; 89/40.01; 280/400

(58) Field of Classification Search
USPC ..... 89/1.13, 1.34, 1.8, 1.815, 40.01, 40.08, 89/40.13, 40.14, 40.15, 1.11; 280/400, 280/423.1, 426, 442, 443, 444; 410/31, 32, 410/33, 78, 79, 80
See application file for complete search history.

(56) References Cited

U.S. PATENT DOCUMENTS

| | | | | | |
|---|---|---|---|---|---|
| 4,141,277 | A | * | 2/1979 | Bouillon | 89/38 |
| 4,282,794 | A | * | 8/1981 | Miller et al. | 89/36.15 |
| 4,683,797 | A | * | 8/1987 | Wittbrodt | 89/1.13 |
| 5,323,683 | A | * | 6/1994 | Dilhan et al. | 89/1.13 |
| 5,675,104 | A | * | 10/1997 | Schorr et al. | 89/1.13 |
| 5,708,230 | A | * | 1/1998 | Woodall et al. | 102/402 |
| 5,929,363 | A | * | 7/1999 | Neff et al. | 89/1.13 |

(Continued)

OTHER PUBLICATIONS

Chris Williams and Matthew Sablan, New Robotic Capabilities Demonstrated at Cobra Gold 2010, Internet Article from TARDEC-GVSET News, Jul. 2010, 2 Pages, vol. 07, Issue 04.

Wikipedia, Anti-Personnel Obstacle Breaching System, Internet Article, 2 Pages.

(Continued)

*Primary Examiner* — Bret Hayes

(74) *Attorney, Agent, or Firm* — David L. Kuhn; Luis Miguel Acosta; Thomas W. Saur

(57) ABSTRACT

The subject munitions deployment platform for an Anti-Personnel Obstacle Breaching System munitions set provides prepositioned compartments to receive the ALICE packs of the munitions set to ensure that they are positioned and aligned for proper deployment. The pre-positioned compartments ensure that when the APOBS is deployed, the front edge of the rear ALICE pack properly engages the rear edge of the front ALICE pack providing a fulcrum aiding rotation of the rear pack allowing it to clear the engaging elements to lift the rear pack off the platform and into the air where it further functions as a drogue to assist in extending the charge line over the chosen target line. Combining the subject platform with a vehicle, or with a towed wagon, allows a Soldier to remain in a safe location while remotely positioning the munitions set to clear a minefield or other anti-personnel obstacle.

14 Claims, 4 Drawing Sheets

(56) References Cited

U.S. PATENT DOCUMENTS

| | | | | |
|---|---|---|---|---|
| 6,935,818 | B2 * | 8/2005 | Hoeper et al. | 410/18 |
| 7,677,587 | B2 | 3/2010 | Fisk et al. | |
| 2010/0025964 | A1 * | 2/2010 | Fisk et al. | 280/444 |
| 2011/0240382 | A1 * | 10/2011 | Gettings et al. | 180/9.1 |

OTHER PUBLICATIONS

Mk7 Antipersonnel Obstacle Breaching Systems (APOBS), Internet Article, GlobalSecurity.Org, 2 Pages.

Anti-Personnel Obstacle Breaching Syst., MK7 Mod 2, Nat'l Defense Industrial Assoc. Gun & Missile Syst. Conf. & Exhibition, Mar. 27-30, 2006, 10 Pages, Picatinny Arsenal, NJ.

* cited by examiner

MODULAR MUNITIONS DEPLOYMENT PLATFORM

CROSS-REFERENCE TO RELATED APPLICATIONS

This application claims the benefit of U.S. provisional application Ser. No. 61/594,633, filed on Feb. 3, 2012.

STATEMENT OF GOVERNMENT INTEREST

The invention described herein may be manufactured and used by or for the United States Government for governmental purposes without the payment of any royalties therefore or thereon. This patent application, and any resulting patent, has been assigned to the United States Government.

FIELD OF THE INVENTION

The subject invention relates to munitions deployment by unmanned ground vehicles, and more specifically to a specially designed modular munitions deployment platform that enables a munitions set specifically designed to be deployed by personnel, to be deployed remotely by a vehicle (e.g., an Unmanned Ground Vehicles (UGV), robot, or the like), and more specifically a modular munitions deployment platform that can be operated in its standard configuration (e.g., the platform's frame mounted to a physical structure as a payload for a UGV or other vehicle, for a wagon towed by an unmanned ground vehicle, or in any other configuration as a means of delivery as understood by one of skill in the art), or to be outfitted with wheels as a wagon to be towed by a UGV. The modular deployment platform is adapted to mount an APOBS Munitions Set in an operative and deployable position. Thus, the invention might also be called a Remote APOBS Deployment System.

BACKGROUND OF THE INVENTION

The Anti-Personnel Obstacle Breaching System (APOBS) is an obstacle clearance system, for clearance of a minefield or other anti-personnel obstacle (hereafter referred to as 'obstacle'), fielded by the US Department of Defense in January 2003. It replaced the prior mine clearance device called the Bangalore Torpedo. The APOBS munitions set uses a rocket to launch a line charge of multiple grenades across a minefield or another anti-personnel obstacle, which grenades are then detonated to create a cleared path through the minefield or obstacle. Currently, the APOBS is contained in two packs, called "ALICE" (All-purpose Lightweight Individual Carrying Equipment) packs, each of which are typically carried and deployed by individual soldiers. The APOBS requires the Soldier to connect and position the two ALICE packs relative to each other and to the minefield or obstacle, in order that the APOBS be properly and effectively deployed. While the APOBS is uniformly considered a vast improvement over the Bangalore torpedoes, the placement of the APOBS system for deployment over an obstacle often still exposes Soldiers to enemy fire. For this reason, deployment of the APOBS would be improved by use of Unmanned Ground Vehicles (UGV) outfitted with a system capable of appropriately deploying the APOBS through a very specific mechanism, thus sparing the Soldiers from unnecessary exposure to hostile fire during positioning and deployment of the APOBS munitions set across the identified targeted area to be cleared.

SUMMARY OF THE INVENTION

The subject invention presents a modular munitions deployment platform that can combine into a system comprising an Unmanned Ground Vehicle (e.g. UGV, robot, or the like) and a method of remote deployment of that platform. The modular deployment platform can be either payload mounted to a physical structure for a UGV, wherein the deployment platform is specifically designed to mount an Anti-Personnel Obstacle Breaching System (APOBS) for deployment for its obstacle-clearing function. Alternatively, the platform may be configured with bolt-on wheels to be configured as a wagon designed to be towed by a UGV. The subject modular munitions deployment platform is provided with compartments specifically sized and designed to hold the two ALICE packs of the existing APOBS munitions set in specific relative positions to facilitate deployment of the APOBS across the obstacle to be cleared. Mounting the subject deployment platform on such wagon or UGV, controlled by a safely positioned Soldier, allows the combined system to transport (e.g., carry, traverse, or the like) the two ALICE packs of the current APOBS Munitions in operative position relative to each other to allow the charge line to be fired over a minefield or other obstacle to be cleared.

The modular munitions deployment platform has a front compartment adapted to receive the front ALICE pack, and a rear compartment adapted to receive the rear ALICE pack. These compartments are fitted with means to accurately position the packs in a unique, functional position, securing the packs appropriately, the front pack to remain in position on the system, and the rear pack to be free to be propelled upward at the end of the charge line to act as a drogue to assist in extending the charge line. The compartments are positioned so that the rear pack pivots around a fulcrum formed by the respective adjacent edges of the two front and rear ALICE packs disengaging the rear ALICE pack from the deployment platform.

DETAILED DESCRIPTION OF THE INVENTION

The present invention is a modular munitions deployment platform 10 adapted to receive the two ALICE packs of a current APOBS munitions set in specific relative positions to facilitate deployment of the APOBS across the obstacle to be cleared. The munitions deployment platform 10 of the present invention may be combined into a system comprising a vehicle 2 (unmanned ground vehicle, robot, or the like, or a motor vehicle), the platform 10 capable of being mounted directly onto the vehicle 2 (or other physical structure), or onto a wagon 4 designed to be towed by the vehicle 2. Whether modular deployment platform 10 is configured or mounted onto an existing structure, onto a vehicle 2, or as a wagon 4 towed by the vehicle 2, careful maneuvering of the vehicle 2 will position munitions deployment platform 10, and the supported APOBS munitions set 100, for deployment of the APOBS to clear a minefield or other anti-personnel obstacle.

Figure 1:
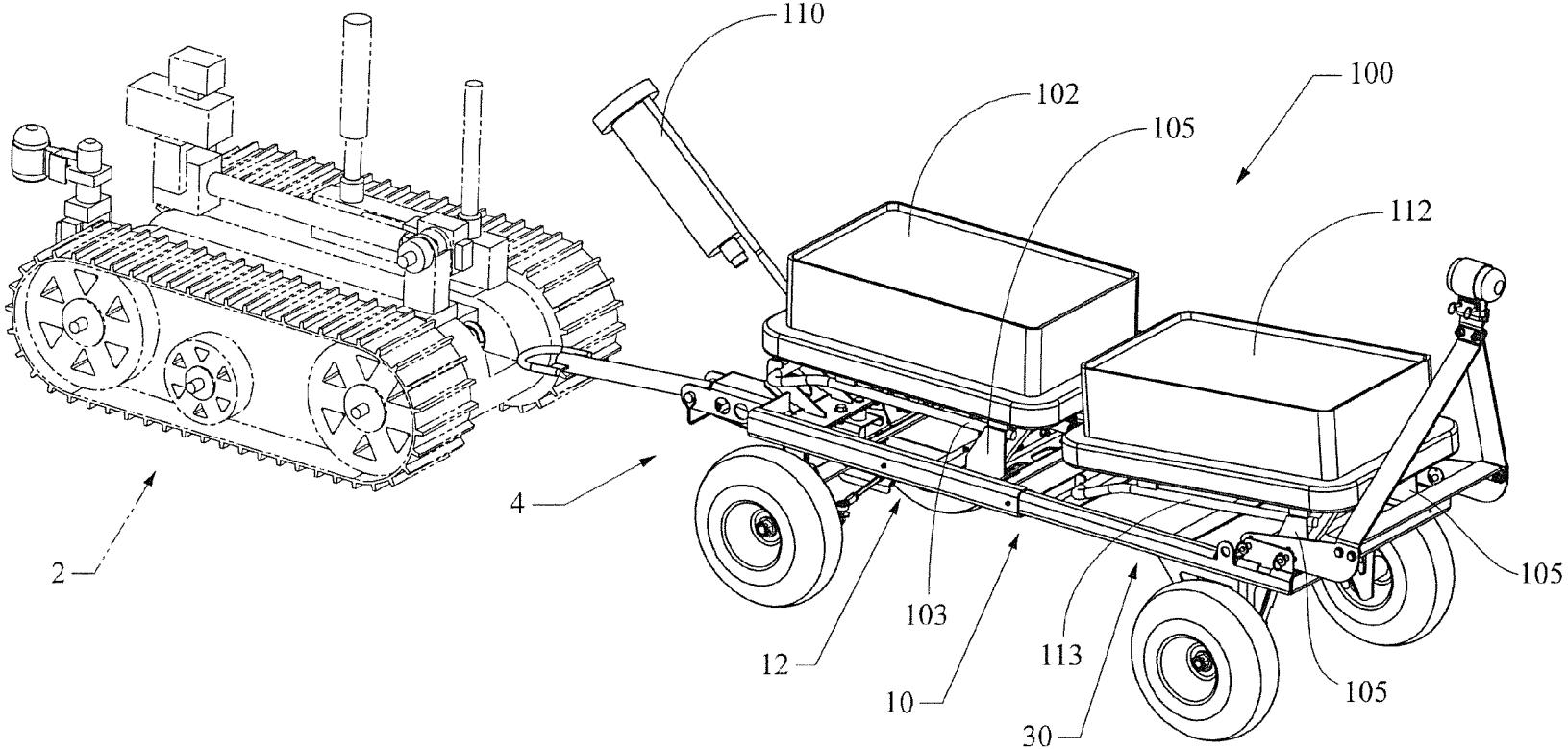
FIG. 1 shows a perspective view of the subject munitions deployment platform in combination with an unmanned ground vehicle and a towed wagon, on which an APOBS munitions set has been loaded.

As seen in FIG. 1, the APOBS munitions set 100 as currently known and used comprises a front ALICE pack 102, and a rear ALICE pack 112. Each ALICE pack includes a frame rail, 103 and 113 respectively, which generally extends at a stand-off distance provided by support elements, along three edges of the underside of the ALICE pack, which like the frame of a backpack, serves to support webbing that braces the ALICE pack, easing the load of the pack as it is carried by a soldier. The lower portions of each side of frame rails 103 and 113 have a projection plate 105 that serve to assist in location of the ALICE pack as is described within. The front ALICE pack 102 contains a first half of a charge line, with a front fuze, as well as a rocket and rocket tube 110. The rear ALICE pack 112 contains the second half of the charge line (connected to the first half of the charge line before deployment), a rear fuze and a drogue chute.

Deployment of the APOBS munitions set 100 requires alignment of these two ALICE packs 102 and 112 at a prescribed distance from a minefield or other anti-personnel obstacle to be cleared. Proper deployment requires aiming the rocket for the desired trajectory, connecting the two halves of the charge line, and placing the two ALICE packs 102 and 112 in proper alignment and position relative to each other, such that the rocket properly drags both halves of the line charge over the selected trajectory, the drogue chute, and attached pack body 120 of rear ALICE pack 112, providing proper drag of the second half (rear pack portion) of the line charge to allow proper extension of the entire line charge. As mentioned, in many cases, soldiers involved in the placement and deployment of the APOBS munitions set at the edge of a minefield or obstacle, without the benefit of an unmanned ground vehicle, robot, or the like combined with the subject invention, are exposed to hostile fire while accomplishing these functions.

A munitions deployment platform 10 in accordance with this invention is sized to accept the APOBS munitions set 100, consisting of two ALICE packs, a front ALICE pack 102 and a rear ALICE pack 112. The front pack 102 is secured to a front compartment 12 of the munitions deployment platform 10 by three features: at least two front toe lugs 24, a spring-loaded latch/release mechanism 50, and two flanges 44. As will be explained later, the latch release mechanism 50 and flanges 44 are part of the rear compartment 30, but serve to secure the front ALICE pack 102 into front compartment 12. The at least two front toe lugs 24, the spring-loaded latch/release mechanism 50, and two flanges 44 generate a multi-point mechanical positioning hold on the front pack 102.

Figure 2:
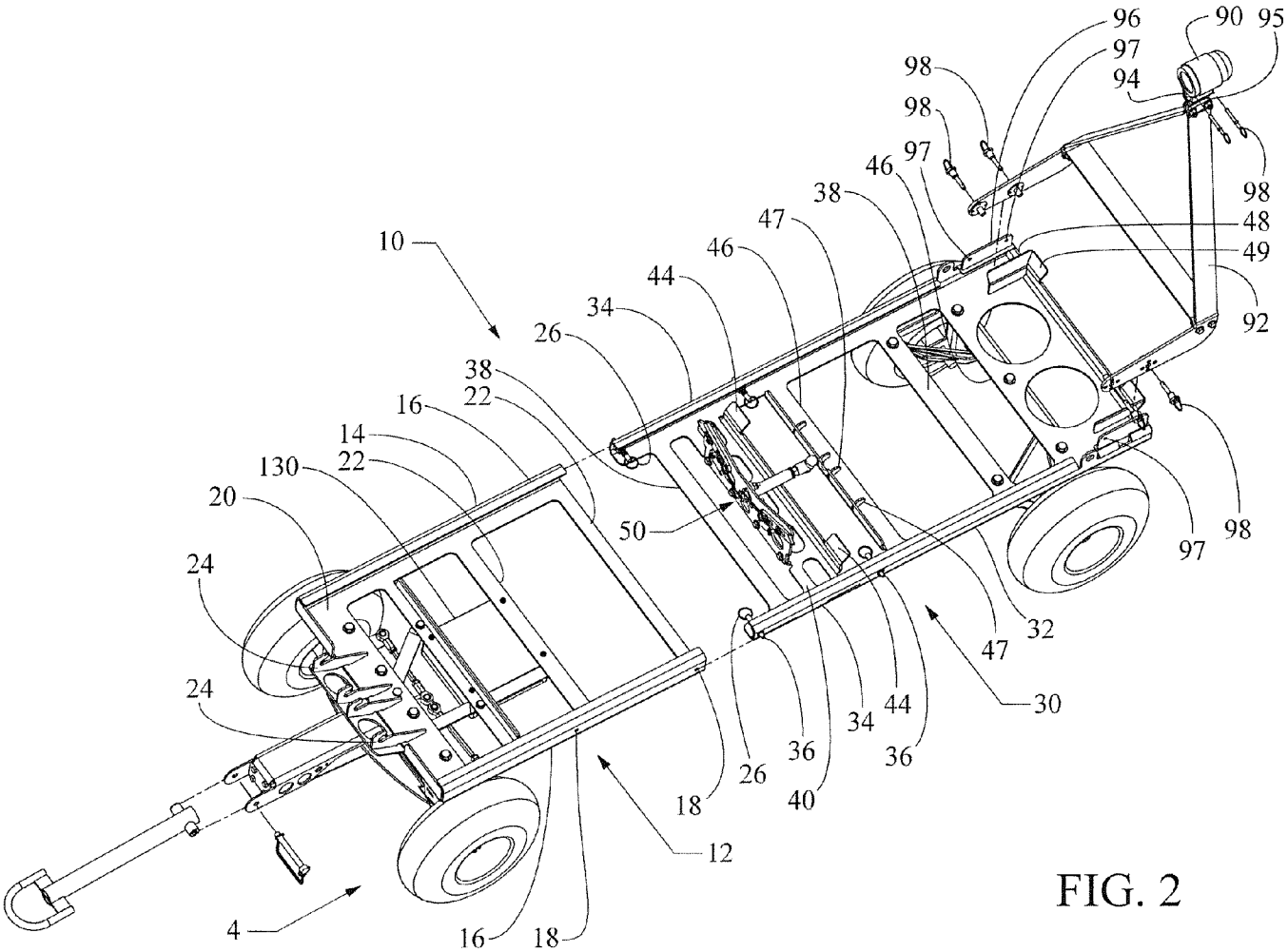
FIG. 2 shows an exploded perspective view of the modular sections of the munitions deployment platform.
Figure 4:
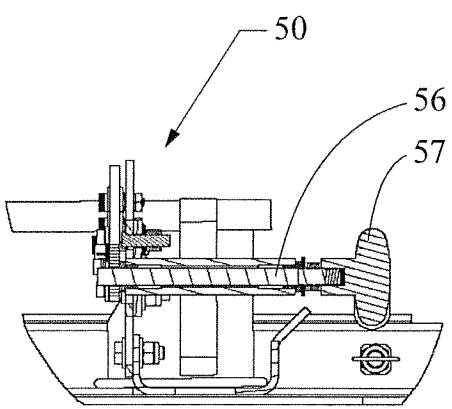
FIG. 4 shows a side cross-sectional view of the latch release mechanism.

The munitions deployment platform 10 includes a front compartment 12 comprising a front frame portion 14. The front frame portion 14 includes two side rails 16. In a preferred embodiment, side rails 16 are U-shaped but those of skill in the art will realize that the precise shape of the side rails is not critical. Each of side rails 16 includes at least two joining holes 18. Front frame portion 14 also includes a front horizontal plate 20 and at least one rear horizontal beam 22. Front horizontal plate 20 and all rear horizontal beams 22 extend between the two side rails 16, forming front frame portion 14. Front compartment 12 also includes at least two front toe lugs 24. However, stability of the mounted front ALICE pack 102 is enhanced by use of multiple toe lugs 24, and a preferred embodiment as shown in FIG. 2 includes four front toe lugs 24. Front toe lugs 24 are flat plates disposed upon front horizontal plate 20 of front frame portion 14, and have a hook end adapted to grasp the frame rail 103 of front ALICE pack 102. The front toe lugs 24 provide forward, vertical, and lateral location and securement of the front ALICE pack 102. The flanges 44 are plates secured to the rear horizontal plate 46 of rear frame portion 32, and provide lead-in guidance for the insertion of front ALICE pack 102 into latch release mechanism 50. The flanges 44 assist in providing a specific location to the front ALICE pack 102 within front compartment 12. This specific location is important to the relative positioning of the front and rear ALICE packs 102 and 112 to ensure their respective operative positions for subsequent deployment of the APOBS munitions set 100.

Munitions deployment platform 10 also includes a rear compartment 30 having a rear frame portion 32. Rear frame portion 32 includes two rear side rails 34, each of the rear side rails 34 having at least two joining holes 36. In a preferred embodiment, rear side rails 24 are U-shaped and are sized to fit snugly within front side rails 16. Those of skill in the art will understand that the precise shape of front side rails 16 and rear side rails 34 are not critical, so long as the respective side rails are shaped and sized to allow the front and rear side rails to slide together in a nesting relationship. When the front frame portion 14 is joined to the rear frame portion 32 by nesting the respective front side rails 16 and rear side rails 34, the joining holes 18 and joining holes 36 are to be aligned so that the respective frame portions can be secured with appropriate fasteners 26. In a preferred embodiment, fasteners 26 will be quick release fasteners.

Rear side rails 34 of rear frame portion 32 are joined to each other by multiple horizontal plates 38. This set of multiple horizontal plates 38 include at least a latch release horizontal plate 40 which plate 40 includes a latch release flange 42 and at least two ALICE pack angled flanges 44. Horizontal plates 38 may also include a toe lug horizontal plate 45 and a rear horizontal plate 46. Those of skill in the art will appreciate that the set of horizontal plates 38 may also be formed as a single horizontal plate.

Figure 3:
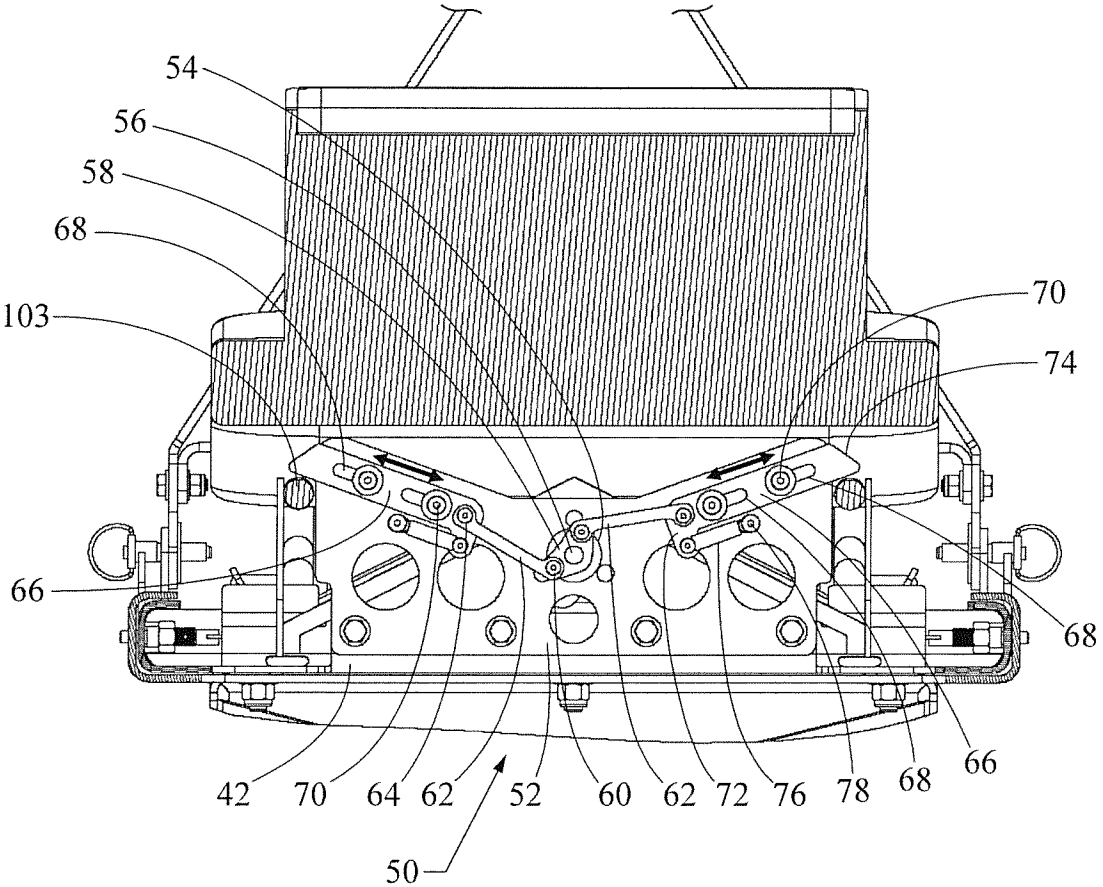
FIG. 3 shows a front cross-sectional view of the latch release mechanism.

The rear compartment 30 also comprises a latch release mechanism 50 which is an element of rear frame portion 32. As shown in FIG. 3, latch release horizontal plate 40 includes a latch release flange 42 which supports a latch release base plate 52. Base plate 52 has a centrally disposed shaft receiving hole 54, through which is mounted a shaft 56. At one end of shaft 56, there is disposed a dihedral plate 58.

The latch release mechanism 50 also includes two link plates 62 which are attached at generally diametrically opposed locations on dihedral plate 58 by dihedral plate shoulder screws 60. Each of the other ends of link plates 62 are joined to one of a pair of sliding dogs 66, respectively, by link plate shoulder screws 64. Each of sliding dogs 66 include a pair of dog slots 68 that are slidably mounted to base plate 52 by slot shoulder screws 70. The more centrally located end of each of sliding dogs 66 has an extended dog end 72. The more distally located end of each of sliding dogs 66 has an angled dog end 74. Extended dog end 72 is connected to a first end of extension spring 76. The second end of extension spring 76 is attached to base plate 52 by spring shoulder screws 78, at a position between extended dog end 72 and angled dog end 74. Thus, each of extension springs 76 tend to bias sliding dogs 66, which are slidably mounted to base plate 52, to a position away from the center of base plate 52.

Each of angled dog ends 74, which are at the end of each sliding dog 66 most distant from the center of the base plate 52, is angled such that the downward pressure of the frame rail of front ALICE pack 102 will move the sliding dog 66 downwardly and towards a central position, against the bias of extension springs 76. When the frame rail 103 of front ALICE pack 102 clears the lower corner of the angled dog end 74, extension springs 76 will again bias the sliding dogs 66 to their outermost position distal from the center of the base plate 52. In this outermost position, each of sliding dogs 66 thus secures the frame rail 103 of the ALICE pack 102. When necessary after deployment of the munitions set 100, shaft handle 57 may be rotated by a user to again overcome the bias of extension springs 76, pulling the sliding dogs 66 into a position near the center of base plate 52. In this manner, the frame rail 103 of ALICE pack 102 is again free to be lifted upwardly and clear of the locked position it previously had beneath the angled dog end 74 of sliding dogs 66. The munitions deployment platform 10 is then ready to receive a subsequent APOBS munitions set 100 for subsequent use.

The rear pack 112 is secured to the rear compartment 30 of munitions deployment platform 10 system by three features: at least two rear toe lugs 47, at least one angled flange 48, and at least one frame flange 49. In a preferred embodiment as shown in FIG. 2, there are four rear toe lugs 47, two angled flanges 48, and two frame flanges 49. The rear toe lugs 47 are flat plates, permanently affixed to toe lug horizontal plate 45 the rear frame portion 32. Toe lugs 47 provide a hooked end to grasp the forward portion of the rear ALICE pack 112 frame rail 113. The rear toe lugs 47 provide forward, vertical, and lateral location and securement of the rear APOBS ALICE pack 112. The angled flanges 48 are bent plates, permanently affixed to rear horizontal plate 45 of rear frame portion 32. The angled flanges 48 provide lateral location of the frame rail 113 of rear ALICE pack 112. The frame flanges 49 are also permanently affixed to rear horizontal plate 45 of rear frame portion 32 and provide lead-in for insertion of projection plates 105 of frame rail 113 of rear ALICE pack 112. The interaction of projection plates 105 with frame flanges 49 ensures that the rear portion of rear ALICE pack 112 is releasably secured in proper and functional position.

FIG. 1 shows the lock down of the two packs through use of the mechanisms described above. It is through the use of these guidance and lockdown components of the front compartment 12 and the rear compartment 30 into which are mounted the front and rear ALICE packs 102 and 112, that the munitions deployment platform 10, when mounted directly on a vehicle (UGV, robot, or other physical structure) as a payload, or configured as a wagon to be towed by a vehicle, is able to endure a vast variation of longitudinal and lateral inclinations (pitch, roll) without the packs 102 and 112 becoming disengaged. The above described features showcase the designs of the toe lugs 24 and 44 and designs of the flanges 36, 46 and 48 that align, hold, and generate a secure fit and precise relative location of each pack 102 and 112.

The current procedure for deployment of the APOBS munitions set 100 is done by hand, by the soldiers who have typically carried the two ALICE packs 102 and 112 on their backs. Proper deployment requires that the two ALICE packs 102 and 112 be positioned on the ground, in a specific spaced and aligned offset configuration, then aimed and fired. Currently these steps are implemented using solely human judgment, and thus the process is susceptible to human error.

Figure 5:
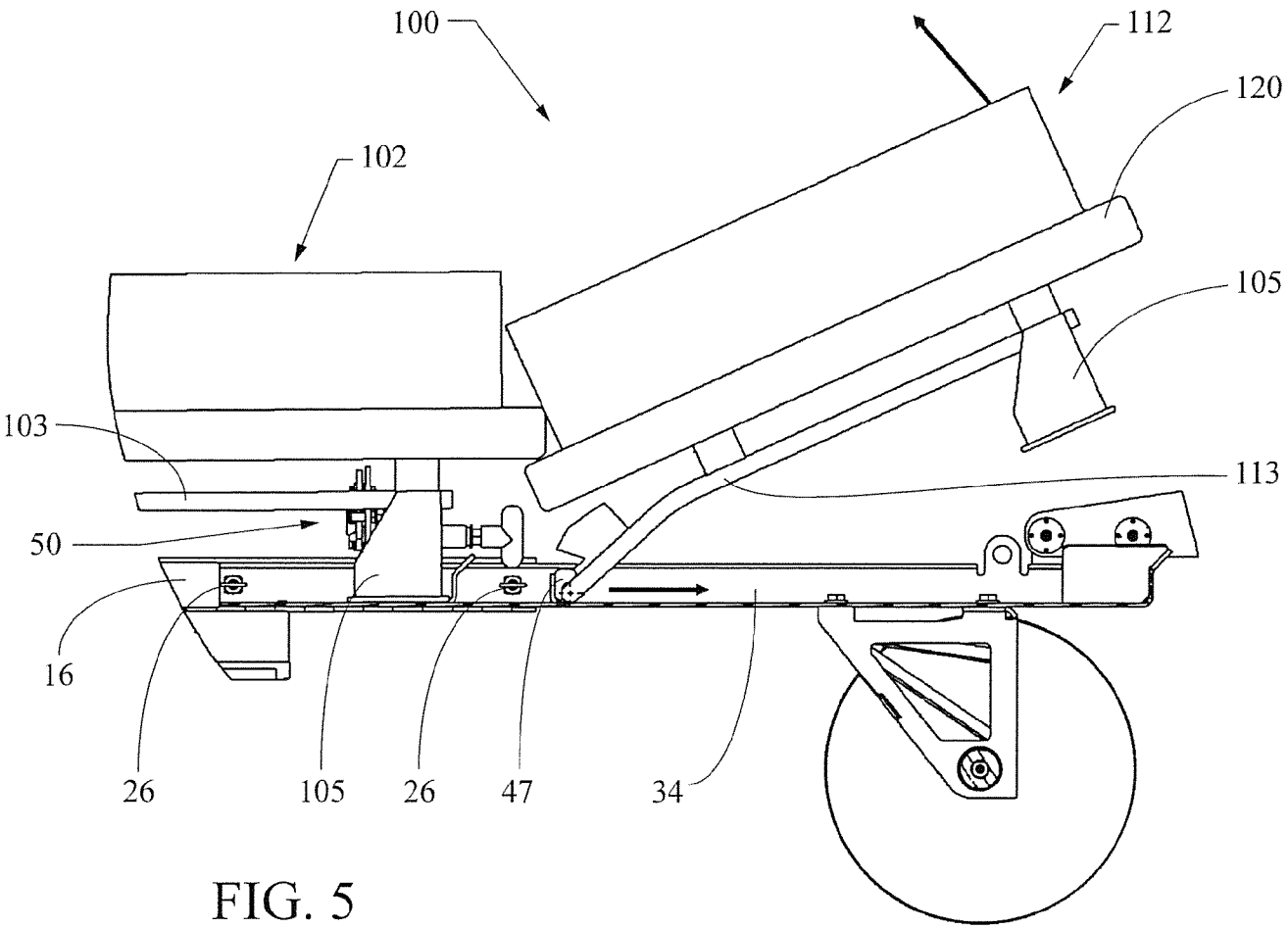
FIG. 5 shows a side view of the platform at the point of deployment of the munitions set in which the front edged of the rear pack engages with the rear edge of the front pack to form a fulcrum which assists the rotation of the rear pack that frees it from the platform.

This invention modifies the current procedure, eliminating a substantial portion of the potential user error, by positioning the two ALICE packs 102 and 112 into the required in-line configuration, by providing front and rear compartments 12 and 30, pre-positioned in proper spatial and aligned relationship. Among the objectives achieved by use of the subject munitions deployment platform 10 is the spacing and alignment of the respective front and rear ALICE packs 102 and 112 that are critical to effectuate the required release of the forward frame rail 113 of the rear ALICE pack 112 from its respective toe lugs 47. As seen in FIG. 5, when the munitions set 100 is launched, the front ALICE pack 102 stays locked to the front compartment 12 by operation of the latch release mechanism 50, while the rear ALICE pack 112 decouples from the munitions deployment platform 10 and is pulled into the air by the rocket propelled munitions.

The decoupling action is accomplished by the upward rotation of rear ALICE pack 112, caused by the continued flight of the rocket which remains connected to rear ALICE pack 112 by the attached charge line. At the initial stage of the decoupling action, rear ALICE pack 112 rotates upwardly about the frontal axis of the rear ALICE pack frame rail 113. As the rotation of rear ALICE pack 112 continues, the front portion of the body of rear ALICE pack 112 contacts the rear portion of the body of front ALICE pack 102. The resulting horizontal area of contact creates a fulcrum, and the continued rotation of rear ALICE pack 112, now rotating about this fulcrum, causes the rear ALICE pack frame rail 113 to move rearwardly in the direction denoted by the arrow, freeing it from rear toe lugs 47. The rear ALICE pack 112 is then able to fly free, acting as a drogue to assist in extending the charge line over the desired target.

As seen in FIG. 2, a camera 90 may be positioned and supported at the end of a camera arm 92. Camera arm 92 may be constructed in any number of ways but preferably is a bolted assembly of formed sheet metal. The camera arm 92 has a camera pan and tilt adjustment bracket 94 at the end, for mounting of camera 90 using quick release pins 98 to facilitate tool-less mounting. A preferred embodiment provides mounting of the pan and tilt adjustment bracket 94 to camera arm 92 with bolts. The camera arm 92 is secured to a pair of tabs 96 disposed on the rear horizontal plate 46, by alignment of bracket holes 95 with tab holes 97 within each of tabs 96, through which aligned bracket holes 95 and tab holes 97 are secured by quick release pins 98. Camera arm 90 is sized to extend upwardly above rear frame portion 32 to a height sufficient to provide direct line of sight over top of the APOBS munitions set 100 to a point on the ground at a prescribed stand-off distance (in accordance to the munitions employed) in front of the unmanned ground vehicle or wagon. While camera 90 may be an independent camera, it may also be the normally rear-facing camera on the unmanned ground vehicle which may be removed from that vehicle and reinstalled in a forward facing position at the top of the pan and tilt bracket 94 on the top of the camera arm 92 to assist in providing wagon alignment and range estimation to target.

As shown in the present figures, the modular munitions deployment platform 10 of the subject invention may be combined with a wagon 200 which is designed to be towed by an unmanned ground vehicle. A suitable wagon 200 may be the one described in U.S. Pat. No. 7,677,587, directed to a robot and trailer system, which disclosure is incorporated by reference herein. Although U.S. Pat. No. 7,677,587 characterizes the relevant component as a trailer, in the subject application, it will be characterized as a wagon, as it is steerable, as it provides the wagon 200 with an "Ackerman" style steering mechanism connected to the front wheels. Wagon 200 is to be modified as necessary to include a support structure suitable to allow selective mounting of the subject munitions deployment platform 10 upon wagon 200 by any suitable attachment means know to current practice.

Of course, modular munitions deployment platform 10 of the subject invention adds a number of features onto the trailer (wagon) of the '587 system to achieve the structure of the present combination making it suitable for the present objective of serving as a robotic platform for the positioning and deployment of the APOBS munitions set 100 mounted upon it. More specifically, the subject munitions deployment platform 10 adds a number of elements necessary to receive and locate the front ALICE pack 102 and rear ALICE pack 112 of the APOBS munitions set 100 into precise position relative to each other, so that the APOBS 100 can deploy properly and effectively.

This wagon also contains a video module enclosure 130 which can house a video overlay module. This enclosure 130 is preferably attached to the underside of front frame portion 12 and more specifically to horizontal beams 22 by any suitable means including but not limited to screws, bolts and nuts, welding or rivets. Those of skill in the art will appreciate that the video module enclosure 130 may also be mounted onto any suitable portion of the vehicle 2, or the wagon 4 towed by a vehicle 2, upon which the subject munitions deployment platform 10 is mounted, so long as suitable electrical connection may be made.

The combination of the video overlay module, and mounted rear camera 90 provides a unique targeting system for this invention. Although the video overlay module is preferably a commercial off-the-shelf item, its application in this invention is unique in that the video overlay is used to generate cross-hairs for munitions alignment to a distant target, and is integrated onto a robot towed wagon 4 or deployable payload 10. While the current standard operating procedures for the APOBS munitions 100 entail staging of the munitions set by hand, with target alignment by user's eye, this invention provides a more precise method for target alignment done remotely without the direct manual aid of the user deploying the munitions and without requiring direct line of sight of the munitions set to target.

One objective of this invention is to provide a modular munitions deployment platform 10 designed for assembly/disassembly and stowage for storage and transportation in shipping crate. It is currently intended that the munitions deployment platform 10 complement a specific unmanned ground vehicle, a TALON manufactured by QinetiQ NA, and/or wagon to be towed by same, and therefore also complement the shipping crates currently used with that unmanned ground vehicle. Of course, other stowage containers can be employed and still be within the spirit of this invention.

Method for Deploying Munitions with the Modular Deployment Platform

The process for using the subject munitions deployment platform 10 will be described in the context of the platform 10 in combination with a wagon 4. The process will be substantially the same if the platform 10 is mounted as a payload directly onto an unmanned ground vehicle 2. In either case, the munitions deployment platform 10 is mounted onto appropriate support elements on unmanned ground vehicle 2 or wagon 4 using any selectively securable and releasable attachment means known to the art. The attachment means may be, for example, screws, nuts and bolts, or quick release locking pins placed through suitably positioned mating holes.

The process begins with the step of joining the front frame portion 14 and the rear frame portion 32 by mating their respective side rails 16 and 34 until joining holes 18 and 36, respectively, are aligned. At that time, quick release fasteners are placed through the mated joining holes 18 and 36, thereby joining the frame portions 14 and 32 into a united modular munitions deployment platform 10. The integral munitions deployment platform 10 is then mounted onto a wagon 4 and the wagon 4 is joined to an unmanned ground vehicle 2. The camera lead from the wagon 4 is connected to the vehicle (UGV, robot, or the like) 2.

The next step mounts the front ALICE pack 102 into front compartment 12 of the subject platform 10. More specifically, as front ALICE pack 102 is positioned over front compartment 12, the front ALICE pack frame rail 103 is engaged under front toe lugs 24. The pack 102 is then lowered such that the projection plates 105 extending from frame rail 103 are guided by flanges 44 into a position whereby the latch/release mechanism 50 engages frame rail 103 of front ALICE pack 102. Pack 102 is pushed down, in turn pushing frame rail 103 down, causing rail 103 to bear against angled dog end 74, which forces the sliding dogs against the bias of springs 76, toward the center of the latch release mechanism 50. The downward motion of the Alice pack 102 is continued until rail 103 clears the edge of angled dog end 74, at which time the bias of springs 76 urges sliding dogs 66 away from the center and locks the frame rail 103, and thus the front ALICE pack 102, into a proper position for effective interaction with the rear ALICE pack 112 for subsequent deployment of APOBS munitions set 100.

The next step of the subject process is to place rear ALICE pack 112 into rear compartment 30 of munitions deployment platform 10. To do this, the soldier tilts the front end of rear ALICE pack 112 so that frame rail 113 is engaged by the hook end of rear toe lugs 47. The rear end of rear ALICE pack 112 is then lowered, being guided into proper position by the interaction of angled flanges 48 and frame flanges 49 upon projection plate 105 of frame rail 113 as the rear end of rear ALICE pack 112 moves downwardly. The rear ALICE pack 112 is thus releasably secured into rear compartment 30 of platform 10.

In a subsequent step, the covers for both ALICE packs 102 and 112 are then removed and discarded, an improved launch rod is inserted into a hole located at the forward location of the front pack 112, and the APOBS munitions 100 are configured for deployment per standard operating procedures aside from the firing mechanism. These standard procedures include: (i) mating the open end of a tube mounted to the side of the rocket to the free tip of the launch rod and moving the rocket downwardly along the launch rod until the rocket is fully engaged, effectively hanging the rocket from the launch rod; (ii) the rocket of the APOBS munitions set 100 is connected to the first half of the charge line, contained within the front ALICE pack 102. The other end of first half is then connected to the second half of the charge line contained within rear ALICE pack 112.

In the next step, the electrical lead of camera 90 that has been mounted onto camera arm 92 is connected to the proper lead of the viewing system of the vehicle 2 towing wagon 4. Then, to connect the firing mechanism, the shock tube detonator is connected to a fire control system mounted on the towing unmanned ground vehicle 2.

In another step, the vehicle 2 and the towed wagon 4, in combination with the mounted munitions deployment platform 10 of the subject invention, are then steered by the operating Soldier into position adjacent the obstacle to be cleared. In this step, the operator will control the unmanned ground vehicle 2 and wagon 4 by use of the navigational camera(s) on the unmanned ground vehicle as well as the target alignment camera 90, maneuvering the combined system of platform 10, ground vehicle 2 and wagon 4, so that the two joined halves of the charge line will fire in the proper, selected trajectory across the minefield or other obstacle.

In the subsequent step, at a time selected by the operator following placement of the system into proper position, the APOBS munitions set 100 is deployed by firing the rocket in the selected trajectory. The firing of the rocket deploys the first half of the charge line, which is operatively connected to the rocket, until it is fully extended from the front ALICE pack 102. As the rocket continues on its trajectory, the second half of the charge line, which has been connected to the first half of the charge line, is also extended from the rear ALICE pack 112. When the entire second half of the charge line is extended, the continued trajectory of the rocket then pulls the rear portion of the body of rear ALICE pack 112.

In this step, as has been described in more detail above, ALICE pack 112 is pulled forward and upward, the front edge of the rear ALICE pack 112 engages the rear edge of the front ALICE pack 102. The contact of these two edges forms a fulcrum around which the attached rear ALICE pack body is pivoted, disengaging the rear ALICE pack frame rail 113 from the rear toe lugs 47 and assisting in elevating the pack into the air as the charge line continues to be extended by the rocket. The rear ALICE pack 112 provides a weight that combines with the drogue chute to ensure full extension of the charge line along the chosen path.

In the next step, once the charge line has been thus deployed across the minefield or other obstacle, the grenades on the charge line are fired, their concurrent explosions also causing detonation of any mines proximate to the grenades along the charge line. With the concurrent detonation of the grenades on the charge line and the adjacent mines, is employed to clear a minefield, a path is cleared though the obstacle.

In a final step, the operator may then turn shaft handle 57 of latch release mechanism 50, causing sliding dogs 66 to open, allowing release of frame rail 103 of front ALICE pack 102 from latch release mechanism 50. The front ALICE pack 102 is then discarded and the munitions deployment platform 10 is again ready for subsequent use.

What is claimed is:

1. A modular munitions deployment platform for an Anti-Personnel Obstacle Breaching System munitions set, said APOBS including a rocket and a charge line, said platform comprising:

a front compartment adapted to receive a front ALL-PURPOSE LIGHTWEIGHT INDIVIDUAL CARRYING EQUIPMENT pack (ALICE pack) of said Anti-Personnel Obstacle Breaching System, said front ALICE pack having, a front edge and a rear edge, a rear compartment adapted to receive and releasably secure a rear ALICE pack of said Anti-Personnel Obstacle Breaching System, said rear ALICE pack having a front edge and a rear edge, the front and rear compartments positioned so that the rear edge of the front ALICE pack and the front edge of the rear ALICE pack form a fulcrum when these two edges come into contact as the rear ALICE pack is pulled by the rocket of the Anti-Personnel Obstacle Breaching System, whereby the rear ALICE pack is rotatably released from said rear compartment to be propelled into the air where the rear ALICE pack can function as a drogue to assist in extending the charge line of the Anti-Personnel Obstacle Breaching System.

2. The modular munitions deployment platform for an Anti-Personnel Obstacle Breaching System munitions set of claim 1, in which said front compartment is formed of:

a front frame portion having a pair of side rails and a front horizontal plate connecting said side rails, at least two front toe lugs disposed on said front horizontal plate, and elements of a rear frame portion, said elements of the rear frame portion including:

a latch release mechanism, and a pair of latch release flanges; and said rear compartment is formed of:

a rear frame portion having a pair of side rails and at least one horizontal plate connecting said side rails;

at least two rear toe lugs disposed on said horizontal plate;

a pair of angled flanges; and a pair of frame flanges.

3. The modular munitions deployment platform for an Anti-Personnel Obstacle Breaching System munitions set of claim 2, in which said at least one horizontal plate includes a latch release horizontal plate, and in which said latch release mechanism comprises:

a flange plate disposed on said latch release horizontal plate;

a base plate disposed on said flange plate, said base plate including:

a generally centrally disposed shaft receiving hole;

a dihedral plate located within said shaft receiving hole and adapted to support a shaft, a pair of sliding dogs, each attached to said dihedral plate by a link plate, each of said sliding dogs urged to a position distal from said dihedral plate by extension springs, each of said sliding dogs having an angled dog end at the distal end away from said dihedral plate, the sliding dogs disposed to slide toward a central position toward said dihedral plate when a frame rail bears downwardly against said angled dog end.

4. The modular munitions deployment platform for an Anti-Personnel Obstacle Breaching System munitions set of claim 1, said platform further comprising:

a camera arm extending upwardly from a rear frame portion of said rear frame compartment;

a camera adjustment bracket disposed at the upper end of said camera arm; and a camera supported upon said camera adjustment bracket.

5. The modular munitions deployment platform for an Anti-Personnel Obstacle Breaching System munitions set of claim 4, wherein said camera is supported on said camera adjustment bracket by quick release pins.

6. The modular munitions deployment platform for an Anti-Personnel Obstacle Breaching System munitions set of claim 4, said front compartment further comprising a video module enclosure disposed on said front frame portion, said video module enclosure supporting a video module in operative connection with said camera.

7. A munitions deployment system comprising:

a modular munitions deployment platform having:

a front compartment adapted to receive a front ALL-PURPOSE LIGHTWEIGHT INDIVIDUAL CARRYING EQUIPMENT PACK (ALICE pack) of an Anti-Personnel Obstacle Breaching System, said Anti-Personnel Obstacle Breaching System including a rocket and a line charge and said front ALICE pack having a front edge and a rear edge;

a rear compartment adapted to receive and releasably secure a rear ALICE pack of said Anti-Personnel Obstacle Breaching System said rear ALICE pack having a front edge and a rear edge;

the front and rear compartments positioned so that the rear edge of the front ALICE pack and the front edge of the rear ALICE pack form a fulcrum when these two edges come into contact as the rear ALICE pack is pulled by the rocket of the Anti-Personnel Obstacle Breaching System, whereby the rear ALICE pack is rotatably released from said rear compartment to be propelled into the air where the rear ALICE pack can function as a drogue to assist in extending the charge line of the Anti-Personnel Obstacle Breaching System; and a vehicle upon which said modular munitions deployment platform is mounted.

8. The munitions deployment system of claim 7 wherein said vehicle is an unmanned ground vehicle.

9. The munitions deployment system of claim 8, in which said front compartment of said modular munitions deployment platform is formed of:

a front frame portion having a pair of side rails and a front horizontal plate connecting said side rails, at least two front toe lugs disposed on said front horizontal plate, and elements of a rear frame portion, said elements of the rear frame portion including:

a latch release mechanism, and a pair of latch release flanges; and said rear compartment is formed of:

a rear frame portion having a pair of side rails and at least one horizontal plate connecting said side rails;

at least two rear toe lugs disposed on said horizontal plate;

a pair of angled flanges; and a pair of frame flanges.

10. The munitions deployment system of claim 9, in which said at least one horizontal plate includes a latch release horizontal plate, and in which said latch release mechanism comprises:

a flange plate disposed on said latch release horizontal plate;

a base plate disposed on said flange plate, said base plate including:

a generally centrally disposed shaft receiving hole;

a dihedral plate located within said shaft receiving hole and adapted to support a shaft, a pair of sliding dogs, each attached to said dihedral plate by a link plate, each of said sliding dogs urged to a position distal from said dihedral plate by extension springs, each of said sliding dogs having an angled dog end at the distal end away from said dihedral plate, the sliding dogs disposed to slide toward a central position toward said dihedral plate when a frame rail bears downwardly against said angled dog end.

11. The munitions deployment system of claim 7 wherein said vehicle is a wagon, said munitions deployment system further comprising an unmanned ground vehicle adapted to tow said wagon.

12. The modular munitions deployment platform of claim 11, in which said front compartment is formed of:

a front frame portion having a pair of side rails and a front horizontal plate connecting said side rails, at least two front toe lugs disposed on said front horizontal plate, and elements of a rear frame portion, said elements of the rear frame portion including:

a latch release mechanism, and a pair of latch release flanges; and said rear compartment is formed of:

a rear frame portion having a pair of side rails and at least one horizontal plate connecting said side rails;

at least two rear toe lugs disposed on said horizontal plate;

a pair of angled flanges; and a pair of frame flanges.

13. The munitions deployment system of claim 12, in which said at least one horizontal plate includes a latch release horizontal plate, and in which said latch release mechanism comprises:

a flange plate disposed on said latch release horizontal plate;

a base plate disposed on said flange plate, said base plate including:

a generally centrally disposed shaft receiving hole;

a dihedral plate located within said shaft receiving hole and adapted to support a shaft, a pair of sliding dogs, each attached to said dihedral plate by a link plate, each of said sliding dogs urged to a position distal from said dihedral plate by extension springs, each of said sliding dogs having an angled dog end at the distal end away from said dihedral plate, the sliding dogs disposed to slide toward a central position toward said dihedral plate when a frame rail bears downwardly against said angled dog end.

14. A process of mounting and deploying an Anti-Personnel Obstacle Breaching System (APOBS) munitions set from a system the APOBS including a rocket and a line charge, comprising:

an unmanned ground vehicle;

a wagon towed by the unmanned ground vehicle; and a modular munitions deployment platform disposed on said wagon, said modular munitions deployment platform including:

a front compartment adapted to receive a front ALL-PURPOSE LIGHTWEIGHT INDIVIDUAL CARRYING EQUIPMENT PACK (ALICE pack) of said Anti-Personnel Obstacle Breaching System, a rear compartment adapted to receive and releasably secure a rear ALICE pack of said Anti-Personnel Obstacle Breaching System, the front and rear compartments positioned so that the rear edge of the front ALICE pack and the front edge of the rear ALICE pack form a fulcrum when these two edges come into contact as the rear ALICE pack is pulled by the rocket of the Anti-Personnel Obstacle Breaching System, whereby the rear ALICE pack is rotatably released from said rear compartment to be propelled into the air where the rear ALICE pack can function as a drogue to assist in extending the charge line of the Anti-Personnel Obstacle Breaching System;

the process comprising the steps of:

mounting a front ALICE pack of an APOBS munitions set into said front wagon compartment on said wagon;

mounting a rear ALICE pack of an APOBS munitions set into a rear wagon compartment on said wagon;

connecting a charge line from said rear ALICE pack to the mating end of a charge line from said front ALICE pack;

connecting said charge line from said front ALICE pack to the rocket of said APOBS munitions set;

positioning the system of an unmanned ground vehicle and a wagon towed from said unmanned ground vehicle into a selected position at the edge of a obstacle to be cleared;

deploying the APOBS munitions set across the obstacle by remotely firing the rocket of the APOBS system such that the rocket drags the charge line of the front compartment until it is fully extended, said rocket then dragging the connected charge line from the rear compartment, said rocket then dragging the entirety of said rear ALICE pack into a pivoting upward rotation against the front ALICE pack, such that the rear ALICE pack cover is also launched into the air, said rear ALICE pack body then acting as a drogue to assist in full deployment of the total charge line across the minefield or other obstacle.

* * * * *